United States Patent [19]

Hwang

[11] Patent Number: 4,983,070

[45] Date of Patent: Jan. 8, 1991

[54] PREFABRICATED CULVERT SYSTEM

[76] Inventor: Hyun-Ho Hwang, 2444 Benny Crescent, Apt. 609, Montreal, Quebec, Canada H4B 2R3

[21] Appl. No.: 371,528

[22] Filed: Jun. 26, 1989

[30] Foreign Application Priority Data

Nov. 21, 1988 [KR] Rep. of Korea ..... 1988-18859

[51] Int. Cl.[5] ..... E01F 5/00

[52] U.S. Cl. ..... 405/124; 405/149; 52/504; 52/731

[58] Field of Search ..... 405/124, 125, 126, 127, 405/150, 151, 149; 52/731, 723, 503, 504, 505

[56] References Cited

U.S. PATENT DOCUMENTS

| | | | |
|---|---|---|---|
| 892,469 | 7/1908 | Vandevort | 405/150 X |
| 1,212,452 | 1/1917 | Caldwell | 405/125 |
| 1,662,714 | 3/1928 | Morgan | 405/124 X |
| 1,854,815 | 4/1932 | Turner | 405/124 X |
| 1,984,196 | 12/1934 | Moss | 405/124 |
| 1,992,763 | 2/1935 | Penny et al. | 405/124 X |
| 1,997,236 | 4/1935 | Schroeder | 405/125 |
| 2,045,514 | 6/1936 | Bietz | 52/505 |

FOREIGN PATENT DOCUMENTS

| | | | |
|---|---|---|---|
| 2124277 | 2/1984 | United Kingdom | 405/126 |

*Primary Examiner*—Dennis L. Taylor
*Assistant Examiner*—Arlen L. Olsen
*Attorney, Agent, or Firm*—Edwin E. Greigg

[57] ABSTRACT

Disclosed is a prefabricated culvert unit comprising a bottom plate, two sidewall plates intended to be positioned onto the upper surface of the bottom plate adjacent to the side edges thereof, and a cover plate intended to be positioned on top of the sidewall plates to form together with these sidewall plates and bottom plate a closed duct. Advantageously, this unit further comprises a pair of shoulders integrally projecting from the lower surface of the cover plate and a pair of ledges projecting upwardly from the upper edges of the sidewall plates to lock the cover plate onto the sidewall plates. The unit also comprises a tongue and groove joint on the upper surface of the bottom plate adjacent each of its side edges and on the lower end of the corresponding sidewall plate, respectively, to lock the sidewall plate and bottom plate together when the culvert unit is assembled.

3 Claims, 2 Drawing Sheets

PREFABRICATED CULVERT SYSTEM

BACKGROUND OF THE INVENTION (a) Field of the Invention

The present invention relates to an improved, prefabricated culvert unit of the type comprising a prefabricated bottom plate, a pair of prefabricated sidewall plates that may be assembled onto the bottom plate, and a prefabricated cover plate that may be assembled on top of the sidewall plates to form altogether a closed duct.

(b) Brief Description of the Prior Art

A prefabricated culvert unit of the above mentioned type is disclosed in Applicant's Korean utility model application No. 85-18268. The culvert unit disclosed in this application has numerous advantages but it also has some disadvantages.

First of all, in this Applicant's prior system, the cover plate is merely laid on top of the upper edges of the sidewall plates. As a result, it is easily subject to inadvertant shifting and misalignment, especially when the culvert is being embedded into the ground.

Another disadvantage of the Applicant's prior culvert unit is that its sidewall plates are both provided at their lower edges with integral projection that extend laterally outwardly and are of such a length that they extend well beyond the side edges of the bottom plate.

A further disadvantage of the Applicant's prior unit is that the bottom panel which is arc-shaped has side edges which are too thin and sharp to bear some of the pressures that may be applied over them during transportation or building on the premises.

SUMMARY OF THE INVENTION

The object of the present invention is to provide an improved, prefabricated culvert unit of the above mentioned type, which improves and complements the Applicant's prior culvert unit that has been briefly disclosed hereinabove. More particularly, the object of the present invention is to provide an improved, prefabricated culvert unit which does not have the disadvantages explained hereinabove.

In accordance with the invention, it has been found that the first disadvantage mentioned hereinabove can easily be overcome if both the cover plate and the upper edges of the sidewall plates are provided with integral projections which are shaped and positioned to match and extend adjacent each other when the cover plate is fitted on the top of the sidewall plates, to lock these elements together and thus prevent any lateral shifting of the cover plate with respect to the sidewall plates.

It has also been found the other disadvantage explained hereinabove can be easily overcome if the side edges of the bottom plate which is intended to receive the bottom edges of the sidewall plates are substantially widened and made at least as wide as is the footing at the bottom edge of each sidewall plate.

It has also been found that the further disadvantage mentioned hereinabove can be easily overcome if the thin and sharp edges of the bottom plate of the cemilar system are made thicker to be capable to support any stress applied over them.

Thus, the present invention proposes an improved, prefabricated culvert system of the type comprising:

a bottom plate having an upper surface, a lower surface and a pair of side edges;

two sidewall plates each having an upper edge and a lower edge, said sidewall plates being intended to be positioned onto the upper surface of the bottom plate adjacent to the side edges thereof; and a cover plate having an upper surface, a lower surface and a pair of side edges, said cover plate being intended to be positioned on top of said sidewall plates to form together with said sidewall plates and bottom plate a closed duct, which system is characterized in that it further comprise:

a set of projections integrally projecting from the lower surface of the cover plate or the upper edges of the sidewall plates or from both of them, to lock said cover plate onto said sidewall plates; and a set of tongue and groove joints on the upper surface of the bottom plate adjacent each of its side edges and on the lower edge of the corresponding sidewall plate, respectively, to lock said sidewall plates and bottom plate together when the culvert system is assembled.

The improved culvert system according to the invention has the following advantages over the known prior art.

First of all, it makes use of a set of matching projections to connect the cover plate to the upper edges of the sidewall plates and of a set of tongue and groove joints to connect the lower edges of the sidewall plates to the bottom plate, thereby making the assembly much more resistant to lateral stresses and inadvertant misalignment.

Secondly, it is very stable when assembled, because of the very specific structure of the joints between the structural components. As a result, the amount of adhesive necessary to complete the structure when assembled is reduced to a minimum.

BRIEF DESCRIPTION OF THE DRAWINGS

The invention will be better understood upon reading the following non-restrictive description of a preferred embodiment thereof, given with reference to the accompanying drawings wherein.

DESCRIPTION OF A PREFERRED EMBODIMENT

Figure 1:
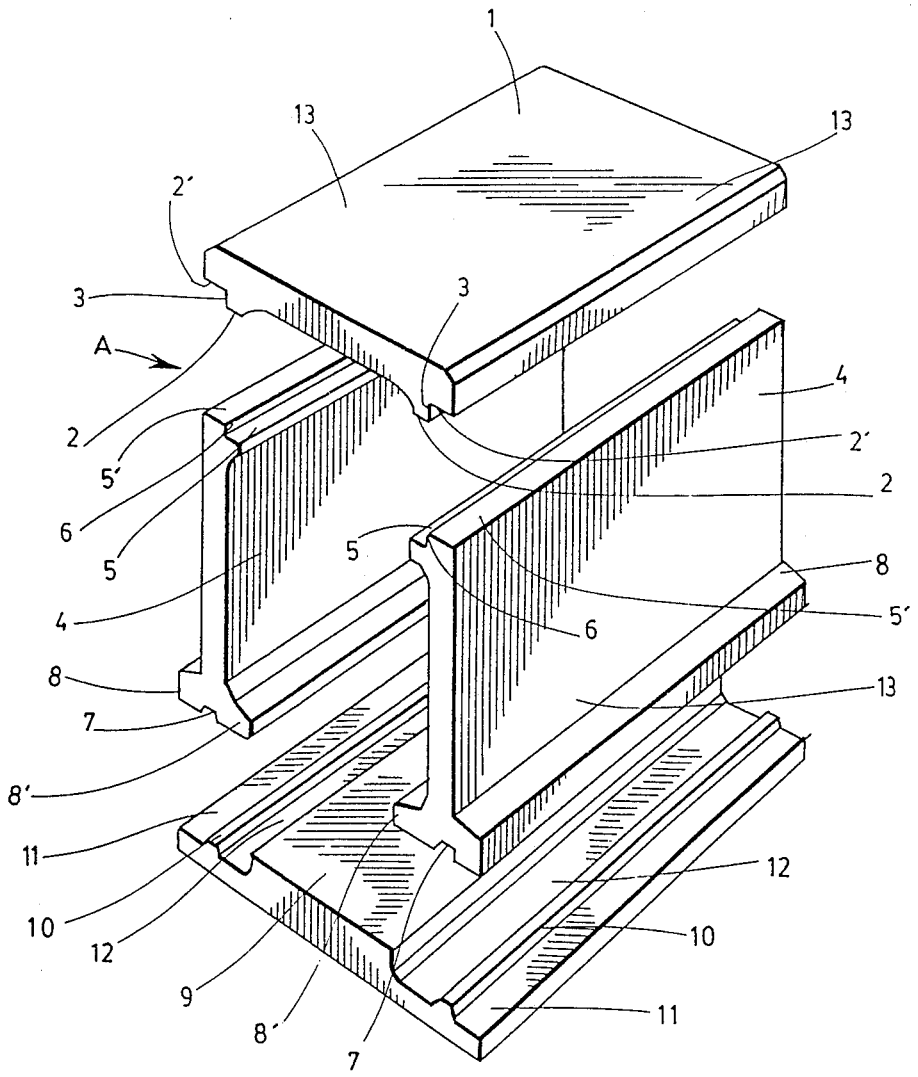
FIG. 1 is an exploded, perspective view of an improved, prefabricated culvert unit according to the invention.
Figure 2:
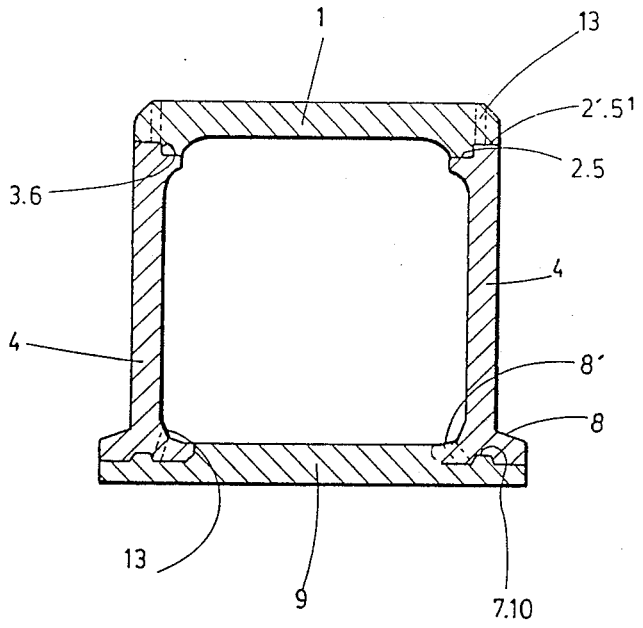
FIG. 2 is a front elevational, cross-sectional view of the unit shown in FIG. 1, in assembled position.

The culvert unit according to the invention as shown in FIGS. 1 and 2 is made of three prefabricated components that may be assembled onto the premises and are preferably made of reinforced concrete, namely a cover plate 1, two sidewall plates 4 and a bottom plate 9.

The cover plate 1 has a lower surface integrally formed with a pair of projections in the form of shoulders 2 that extend parallel to its side edges at a short distance from these edges, respectively. These shoulders 2 form three narrow join surfaces which extend along the full length of the cover plate 1 on both sides thereof. More particularly, each shoulder 2 forms a first, horizontal join surface defined by its lower surface; a second, vertical joining surface 3 which is defined by its outside wall and a third, horizontal join surface 2' defined by the lower surface of the cover plate between the shoulder 2 and the adjacent edge of the cover plate 1.

The upper end of the sidewall plates 4 are provided with a corresponding set of integral inner ledges 5 located short of the top edges faces 5' and defining nooks with the top ends of the plates 4 for receiving the shoulders 2, when the cover plate 1 is fitted on top of the sidewall plates 4 as is shown in FIG. 2. Each ledges forms on the upper end of the corresponding sidewall plate 4 another set of thin narrow join surfaces comprising a first, horizontal join surface defined by the upper surface of the ledge 5; a second, vertical join surface 6 defined by the inside, vertical wall of the sidewall 4 and a third, horizontal join surface defined by the upper end surface 5' of the sidewall 4.

These two sets of joining surfaces 2, 3 and 2' and 5, 6 and 5', respectively, are facing each other and cooperate to form a pair of structural joints on both sides of the cover plate 1 when this cover plate is mounted on top of the sidewall plates 4. In such a position, the join surfaces 3 of the cover plate 1 extend on top of the join surfaces 5 of the sidewalls plate 4 while the join surfaces 2 of the cover plate 1 extends on the join surface 5' of the sidewall plates 4.

The lower ends of both sidewall plates 4 are each provided with an integral footing which comprises a centrally positioned groove 7 whose sidewalls slant outwardly downwardly to form a concavity of isosceles trapezium shape; an outer footing section 8 which extends outwardly of the outer slant of the groove 7 and an inner footing section 8' which extends inwardly of the inner slant of the same groove 7.

The horizontal bottom plate 9 comprises, a central portion and rabbets formed along its lateral edges for receiving a footing of one of the sidewall plate 4. Each rabbet has a base surface which is divided into two join surfaces 11 and 12 by a centrally positioned tongue 10. The join surface 11 of each base is intended to receive the bottom surface of the outer footing section 8 of the corresponding sidewall plate. The central tongue 10 is positioned and shaped to fit into the concave groove 7 and form therewith a tongue and groove joint. The other join surface 12 together with the central portion of the bottom plate 9 and the tongue 7 form another groove in which the inner projection 8' of the corresponding sidewall plate 4 may nest, as is shown in FIG. 2.

The basic structure of the plates used in the culvert system according to the invention and disclosed hereinabove is very simple, thereby making the prefabrication of these plates easy to carry out by casting and, therefore, economic. In addition, this basic structure is strong and resistant to the shocks the components may undergo during their transportation and assembly.

Similarly, the resulting unit when buried is particularly resistant to any stress resulting from the weight of the earthfill, because of the multiple join surfaces provided between the plates which allow snug filling of the joint parts and rigidly hold the sidewall both vertically and laterally.

I claim:

1. A prefabricated culvert unit comprising a horizontal bottom plate including a bottom, upper, and side surfaces, parallel spaced rabbets formed in said upper surface along the length of said bottom plate laterally of each side surface, said parallel spaced rabbets forming a central tongue portion therebetween along the length of said bottom plate, a pair of side wall plates that extend vertically upwardly from said bottom plate above said parallel rabbets and said central tongue portion, each of said side wall plates having upper and lower ends;

footings formed integral with said sidewall plates along the length of the lower ends thereof; each footing having inward and outward laterally projecting footing sections that fit snugly into each of said rabbets on said horizontal bottom plate;

tongue and groove joint means formed in said footing centrally of said inward and outward laterally projecting footing sections so that said tongue fits into said groove joint means, said outward laterally projecting footing section having an outer face forming a vertical plane with said side surfaces of said horizontal bottom plate, said tongue and groove joint means on said upper surface of said horizontal bottom plate and said footings of said pair of wall plates interfitting for holding said sidewall plates against lateral displacement relative to said upper surface of said horizontal bottom plate;

a pair of ledges, each ledge being formed at and integral with the upper end of each of said sidewall plates, each ledge being located below the top edge of said sidewall and projecting inwardly of said sidewall, said ledges and sidewall plate upper ends defining shoulder-receiving nooks;

a cover plate which overlies said top edges of said sidewall plates for closing said culvert unit, said cover plate having a lower surface facing inward of said unit and including side edges;

a pair of shoulders formed integral with said cover plate, each of said pair of shoulders projecting down from said cover plate lower surface and located inwardly of the side edges of said cover plate, outwardly extending shoulders which extend from each of said downwardly extending shoulders being on a higher plane and extending outwardly to said side edges;

wherein said ledges and said shoulders are positioned and configured for said shoulders to fit snugly into said shoulder-receiving nooks.

2. A culvert unit as claimed in claim 1, wherein said tongue-and-grove joint means comprise, in each of said rabbets, a tongue, having the shape of an isosceles trapezium in transverse cross section and, in each of said footings, a groove like shape for receiving said tongues.

3. A culvert unit as claimed in claim 2, wherein said grooves are provided between said footing sections and said tongues are provided at the center of said rabbets.

* * * * *